US006450108B2

(12) United States Patent
Bool, III et al.

(10) Patent No.: US 6,450,108 B2
(45) Date of Patent: Sep. 17, 2002

(54) FUEL AND WASTE FLUID COMBUSTION SYSTEM

(75) Inventors: Lawrence E. Bool, III, Hopewell Junction, NY (US); John Erling Anderson, Somers, NY (US); Glenn William Arnold, Poughkeepsie, NY (US); Christopher Brian Leger, Houston, TX (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/791,614

(22) Filed: Feb. 26, 2001

Related U.S. Application Data

(63) Continuation-in-part of application No. 09/534,523, filed on Mar. 24, 2000.

(51) Int. Cl.[7] ..... F23L 7/00; F23L 1/10

(52) U.S. Cl. ..... 110/348; 110/214; 110/262; 431/9; 431/353

(58) Field of Search ..... 431/2, 3, 5, 8, 431/202, 6, 10, 9, 353; 110/203, 233, 210, 211, 214, 262, 348

(56) References Cited

U.S. PATENT DOCUMENTS

| | | | | |
|---|---|---|---|---|
| 2,678,615 A | | 5/1954 | Soderlund et al. | 110/7 |
| 3,607,119 A | * | 9/1971 | Nesbitt et al. | 23/277 C |
| 4,013,396 A | * | 3/1977 | Tenney | 431/11 |
| 4,035,158 A | * | 7/1977 | Scott et al. | 23/278 |
| 4,127,387 A | | 11/1978 | Vanderveen et al. | 422/158 |
| 4,338,870 A | | 7/1982 | Lanier, Jr. | 110/346 |
| 4,343,605 A | | 8/1982 | Browning | 431/8 |
| 4,395,223 A | | 7/1983 | Okigami et al. | 431/8 |
| 4,416,610 A | | 11/1983 | Gallagher, Jr. | 431/4 |
| 4,496,306 A | | 1/1985 | Okigami et al. | 431/8 |
| 4,515,093 A | | 5/1985 | Beardmore et al. | 110/347 |
| 4,624,631 A | * | 11/1986 | Kobayashi et al. | 431/9 |
| 4,724,780 A | | 2/1988 | Hoffert et al. | 110/263 |
| 4,753,593 A | * | 6/1988 | Mutchler | 431/265 |
| 4,824,643 A | | 4/1989 | Gravely et al. | 422/151 |
| 4,830,604 A | * | 5/1989 | Korenberg | 431/158 |
| 4,863,371 A | | 9/1989 | Ho | 431/9 |
| 4,875,851 A | * | 10/1989 | Mutchler | 431/6 |
| 4,957,050 A | | 9/1990 | Ho | 110/346 |
| 5,000,102 A | | 3/1991 | Ho | 110/346 |
| 5,205,728 A | | 4/1993 | Mansour | 431/1 |
| 5,252,297 A | | 10/1993 | Nakai | 422/150 |
| 5,266,024 A | | 11/1993 | Anderson | 431/11 |
| 5,366,371 A | | 11/1994 | Mansour et al. | 431/1 |
| 5,388,985 A | | 2/1995 | Musil et al. | 431/116 |
| 5,593,302 A | | 1/1997 | Althaus et al. | 431/353 |
| 5,762,486 A | | 6/1998 | Leger | 431/8 |
| 5,817,909 A | * | 10/1998 | Lescuyer et al. | 588/205 |
| 6,128,894 A | * | 10/2000 | Joos et al. | 60/39.06 |

FOREIGN PATENT DOCUMENTS

| | | |
|---|---|---|
| GB | 1467123 | 3/1977 |

* cited by examiner

*Primary Examiner*—Ira S. Lazarus
*Assistant Examiner*—Kenneth B. Rinehart
(74) *Attorney, Agent, or Firm*—Stanley Ktorides

(57) ABSTRACT

A system for combusting difficult to combust fluid such as waste fluid wherein fuel and gaseous oxidant combust in a hot combustion gas chamber to form a hot combustion gas mixture which is accelerated to a high speed and at a steady, i.e. non-pulsing, flow is then used to atomize and then combust the fluid.

8 Claims, 2 Drawing Sheets

FUEL AND WASTE FLUID COMBUSTION SYSTEM

This application is a continuation-in-part of application Ser. No. 09/534,523, filed Mar. 24, 2000.

TECHNICAL FIELD

This invention relates generally to combustion of combustible fluids and, more particularly, to the combustion of waste fluid.

BACKGROUND ART

Numerous devices currently exist to combust fuels and waste materials. The devices include combustion systems, such as boilers and waste-to-energy facilities, which utilize the heat generated by combustion for the generation of process heat, steam or power. Other common combustion facilities include devices whose primary purpose is waste destruction, such as rotary kilns, multiple hearth incinerators, and fluidized bed incinerators. These devices are used to combust a wide range of materials, and they are typically able to handle low heating value waste materials, aqueous wastes, or physically hard-to-handle waste materials such as sludges. However, this capability comes at a high cost; these devices are mechanically complex, capital intensive, maintenance intensive, and they are usually fuel intensive as well when burning wastes containing little heating value. Liquid wastes, such as waste oils, are frequently used as fuels in industrial furnaces if they have a sufficiently high heating value. However, there are numerous liquid waste streams that cannot be used for this purpose because conventional burners will not produce a stable flame with them. These wastes become much more expensive to dispose of as a result, even though they contain considerable heat energy.

Aqueous wastes are by definition never used as fuels because they contain so much water. Disposal costs can be very high, especially if they must be incinerated. Currently they are simply sprayed into a furnace, where other fuels are combusted to supply the heat to evaporate the water. Sludges are particularly problematic because of their poor physical handling characteristics. They may have high or low heating values, but it is usually difficult to get them to burn because of their stickiness and tendency to clump up. For example, sludges from wastewater treatment systems are burned almost exclusively in multiple hearth furnaces or fluid bed incinerators, mainly because these furnaces can handle the sticky material without plugging up.

The current industry practice is to avoid the use of these poor quality waste materials as fuels. Typically these wastes can only be incinerated in specialized furnaces, such as rotary kilns, multiple hearth incinerators, and fluidized bed incinerators which are mechanically complex, capital intensive, maintenance intensive, and usually fuel intensive when burning wastes containing little heating value.

Rotary kiln incinerators tend to be mechanically complex and expensive to operate and maintain. Multiple hearth incinerators are designed specifically to handle sludges from wastewater treatment processes. They rely on mechanical arms to break-up the sludge, move it through the furnace, and expose it to flames. These incinerators are even more mechanically complex than rotary kilns, with associated high capital, operating and maintenance costs. Depending on the moisture content of the sludge, these incinerators may require large amounts of auxiliary fuel. Because of their specialized design, these furnaces are poor at handling variations in the waste materials, including variations in moisture content, volatile organic content, and physical consistency of the sludge. As an example, these furnaces have difficulty when fed grease-laden scum in amounts greater than a few percent of the total sludge feed. The scum, derived from wastewater skimming operations, causes smoking, high organic emissions, local overheating, and generally poor operability. At the other extreme, sludge that is much wetter than normal can lead to a drastic reduction in waste throughput, high fuel requirements, and difficulty in achieving complete destruction of the organics.

Fluidized bed incinerators make use of an inert bed of material that is fluidized with air from below. This design is suitable for incinerating wet materials because the turbulence and thermal inertia of the fluidized bed provides rapid drying of the moisture-laden waste. However, the design is mechanically complex and requires relatively large amounts of high pressure fluidizing air. Precise control must be maintained to achieve efficient incineration. The amount of fluidizing air must be carefully balanced against the mass of the bed, with too much air leading to attrition of particles and too little air causing loss of fluidization and local cold spots in the bed. The bed temperature must also be carefully balanced by control of the waste feed rate and auxiliary fuel feed rate. If the temperature gets too low, organic emissions become a problem, and if the temperature gets too high, fused ash may cause the bed to agglomerate and fluidization will be lost. Agglomeration of some types of sludge into large masses can also be a problem.

One way to handle hard to burn wastes and fuels is through the use of a pulse combustion system. When the chamber geometry and operating conditions of a combustion chamber are such that the acoustic, or pressure, waves generated during combustion are in phase with the energy release, a stable high frequency oscillating flow is formed. This oscillating flow can significantly increase heat transfer and reaction kinetics in reacting systems. When a pulsed combustor is coupled with an atomizing device, the pressure waves serve to atomize the fluid while the hot combustion products dry the droplets. Although capable of handling many types of materials, these systems must be very carefully designed and operated to maintain the correct phase relationship between the acoustic waves and the energy release.

Although easier to deal with than many waste fluids, other difficult to combust fluids such as heavy oil, coal-water slurries, orimulsion, and entrained solid fuels as well as conventional fuels can also benefit from the improved combustion system of this invention.

Accordingly, it is an object of this invention to provide an improved system for combusting waste fluid and other difficult to combust fluids.

SUMMARY OF THE INVENTION

The above and other objects, which will become apparent to those skilled in the art upon a reading of this disclosure, are attained by the present invention, one aspect of which is:

A method for combusting difficult to combust fluid comprising:

(A) contacting fuel with gaseous oxidant and combusting fuel with a portion of the gaseous oxidant to produce a hot combustion gas mixture containing gaseous oxidant;

(B) passing the hot combustion gas mixture through a nozzle to form a high speed combustion gas mixture having a steady flow;

(C) contacting the high speed steady flow combustion gas mixture with a flow of difficult to combust fluid and atomizing at least some of the flow of said fluid by the contact with the high speed steady flow combustion gas mixture; and (D) combusting the atomized fluid by reaction with the gaseous oxidant of the high speed steady flow combustion gas mixture.

Another aspect of the invention is:

Apparatus for combusting difficult to combust fluid comprising:

(A) a hot combustion gas chamber, means for providing a non-pulsing flow of fuel into the hot combustion gas chamber, and means for providing a non-pulsing flow of gaseous oxidant into the hot combustion gas chamber;

(B) an atomization chamber and means for providing difficult to combust fluid into the atomization chamber;

(C) a nozzle positioned for receiving a steady flow of fluid from the hot combustion gas chamber and for ejecting a steady flow of fluid into the atomization chamber; and (D) a combustion zone in flow communication with the atomization chamber.

As used herein the term "atomizing" means to make in the form of many droplets or particles.

As used herein the term "nozzle" means a device having an input for receiving a fluid and an output for ejecting a fluid whereby the fluid exits the device at a higher velocity than it has when entering the device.

As used herein the term "waste fluid" means a fluid typically containing organics, either as solids (sludges) or liquids, residue or byproduct that by its nature is not reused and must be disposed of.

As used herein the term "difficult to combust fluid" means one or more of waste fluid, conventional fuels, heavy oil, coal-water slurry, orimulsion and entrained combustible solids.

As used herein the term "steady flow" means non-oscillating or non-pulsing flow, i.e. a flow of fluid wherein the bulk flow is continuously moving without rapid cessation or reversal of direction.

DETAILED DESCRIPTION

Figure 1:
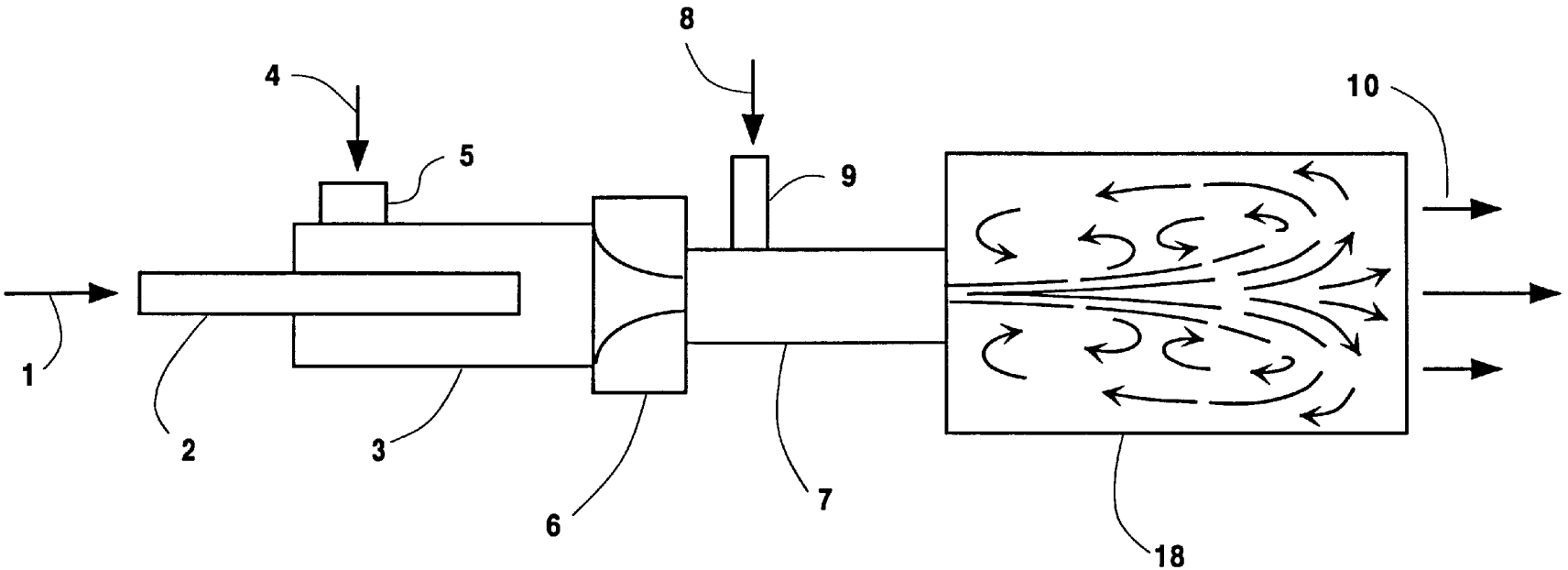
FIG. 1 is a simplified representation of one preferred embodiment of the fluid combustion system of the invention.

The invention will be described in detail with reference to the Drawings. Referring now to FIG. 1, fuel 1 is provided into fuel tube 2 which is positioned for delivering the fuel into hot combustion gas chamber 3 in a non-pulsing flow. The fuel may be any suitable fluid fuel such as methane, propane, natural gas, fuel oil, kerosene and the like.

Gaseous oxidant 4 is provided into gaseous oxidant tube 5 which is positioned for delivering the gaseous oxidant in a non-pulsing flow into hot combustion gas chamber 3. The gaseous oxidant may be air, oxygen-enriched air or commercial oxygen having an oxygen concentration of at least 99.5 mole percent. None of the fluids provided into the combustion chamber are provided using an aerodynamic valve or a mechanical valve such as would be used in a pulse combustion system to create the pulsating flow. In the practice of this invention the flow of fluids into the combustion chamber is externally controlled. Preferably the gaseous oxidant has an oxygen concentration of at least 21 mole percent, most preferably of at least 75 mole percent.

Within hot combustion gas chamber 3 the fuel and the gaseous oxidant mix and react in a combustion reaction wherein some, but not all, of the oxygen of the gaseous oxidant combusts with the fuel. The reaction of the fuel with the gaseous oxidant within hot combustion gas chamber 3 produces a hot combustion gas mixture which comprises combustion reaction products, such as carbon dioxide and water vapor, as well as remaining uncombusted gaseous oxidant. Due to the combustion reaction within the confined volume of hot combustion gas chamber 3, the temperature of the combustion gas mixture within chamber 3 is at least 300° F. and generally within the range of from 1000 to 3000° F.

The hot combustion gas mixture passes in a steady flow from hot combustion gas chamber 3 into the input of nozzle 6. Nozzle 6 may be a pipe end, a converging nozzle, such as is illustrated in FIG. 1, or it may be a converging/diverging nozzle. As the hot combustion gas mixture passes through nozzle 6, it is accelerated to a high speed. Nozzle 6 communicates with atomization chamber 7. The hot combustion gas mixture passes out from the output of nozzle 6 at a steady flow into atomization chamber 7 as a high speed hot combustion gas mixture having a steady flow and a velocity of at least 300 feet per second (fps) greater than the unheated inlet gaseous oxidant, and generally having a velocity within the range of from 1000 to 3000 fps.

Difficult to combust fluid such as waste fluid 8 is provided into fluid tube 9 which is positioned for delivering the waste fluid into the atomization chamber 7. In the embodiment of the invention illustrated in the Figure, the flow of waste fluid is provided into atomization chamber 7 in a direction of about 90 degrees to the flow of the high speed hot combustion gas mixture through atomization chamber 7. It is understood, however, that the contact of the fluid flow with the stream of high speed hot combustion gas mixture within chamber 7 could be at any effective angle including about 0 degrees, i.e. substantially aligned flow of the waste fluid stream and the high speed hot combustion gas mixture stream within atomization chamber 7.

The invention differs from conventional systems which use pulses or oscillation to atomize difficult to combust fluid by using steady flow turbulent gas at a high temperature and at a high velocity to achieve the atomization. An oscillating or pulsating flow system uses pressure waves to break the fluid into droplets. These pressure pulses create intense noise at a frequency, 1000 to 6000 Hz, where human hearing is most sensitive. In contrast, the invention creates a lower intensity of steady (no dominant frequency), turbulent jet noise, which is less objectionable even at a given sound intensity. The pressure pulses also create vibrational stresses in the burner and any equipment attached to it, leading to problems such as fatigue failure of materials and stress corrosion cracking. Transfer of these vibrational stresses to downstream components or refractory lining will significantly reduce the useful life of these components. The invention avoids all these issues because there are no pressure pulses or vibrations. In addition, the oscillating flow reverses direction for part of each pulse, which could draw the atomized fluid droplets or particles back into the resonator tubes or the pulse combustor chamber, potentially causing buildups, corrosion or erosion in these parts. If the droplets ignite in this area, it could cause local overheating of the burner. The invention has one-directional steady flow, which prevents fuel particles or droplets from going upstream through the nozzle and into the oxygen combustion chamber. Finally, the composition and temperature of the atomizing fluid from the pulsed combustor is unsteady, potentially leading to higher emissions of hydrocarbons, Nox, CO, or soot.

Pulsed flow systems are also more inherently complex than the present invention. The pulse combustor is a specially tuned device requiring considerable expertise to design and fabricate and must typically operate within a narrow range of flows and conditions. The special tuning requirement of the device will necessitate frequent maintenance to operate at optimum conditions. The invention has no moving parts and needs no tuning or maintenance other than the occasional cleaning. Further, if aerodynamic air inlet valves are used, these require considerable design effort and will be suited to a relatively narrow range of flow rates. If mechanical air inlet valves are used, this is a moving part subject to failure and requiring maintenance. The narrow operating range of the device limits turndown, and limits flexibility to change gas characteristics, such as temperature and composition, without significant changes in hardware and flows. In contrast, the present invention is a very simple design with no moving parts and externally controlled fuel and oxidant flows, and only requires occasional cleaning for optimal operation. Further, this invention uses a simple turbulent diffusion burner to maintain combustion, which is stable over a wide range of flows and conditions.

In the preferred practice of this invention at least one of, and preferably both, of the hot combustion gas chamber 3 and the atomization chamber 7 are substantially cylindrical, i.e. have substantially the same diameter along their length. The cylindrical shape aids in the attainment of the important steady flow of the invention.

Among the many fluids which can be used in the practice of this invention one can name sludges, such as sewage sludge, low heating value liquids, aqueous wastes, high viscous fluids with medium heating values such as skimmings, and slurries of suspended solids.

Although the invention may be used to combust fluid having any heating value and flowable viscosity, the invention will have particular utility for the combustion of fluid having relatively low heating value, such as below 10,000 BTU/lb, typically between 1000 and 6000 BTU/lb, and/or relatively high viscosity, such as 20 centipoise or more although it may be used to process fluids having lower viscosities such as 1 centipoise.

Figure 2:
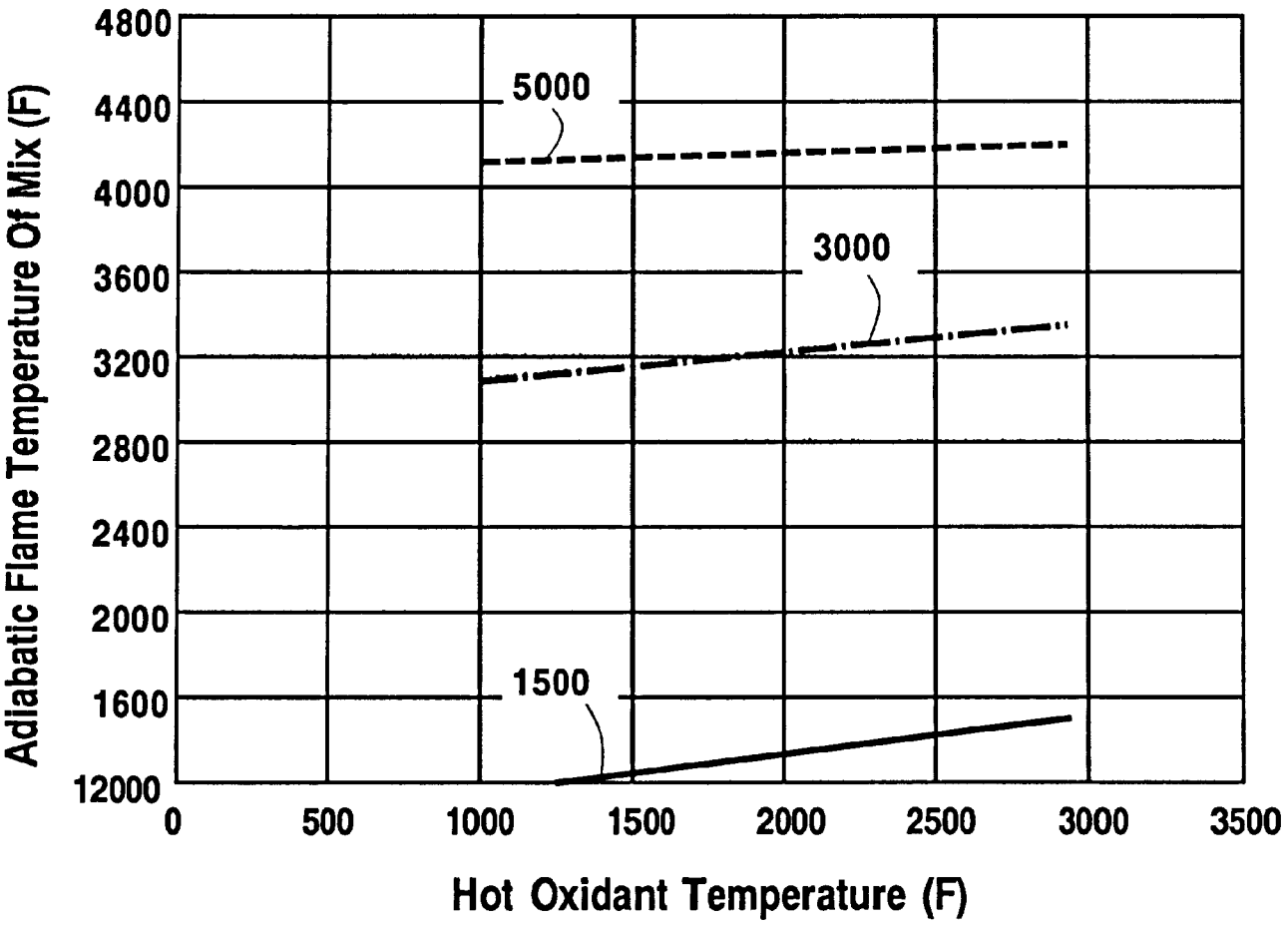
FIG. 2 is a graphical representation of the flame temperature achievable with the use of heated oxygen to combust low heating value fluids.

The impact of using heated oxygen to combust low heating value fluids is shown in FIG. 2. For the data presented in FIG. 2, ambient temperature oxygen is assumed to be heated by combustion with natural gas, similar to the embodiment previously discussed, to some temperature. This heated oxygen is then used to combust a fluid having a heating value of 5000 Btu/lb, 3000 Btu/lb, or 1500 Btu/lb. In this example it is assumed that excess oxygen is supplied such that the flue gas contains approximately 1% oxygen by volume, wet. As can be seen from FIG. 2, increasing the oxygen temperature serves to increase the flame temperature. Thus, even with an aqueous waste containing as little as 1500 Btu/lb heating value, it is possible to reach temperatures of 1500° F. Higher temperatures are available if the oxygen is heated beyond 3000° F.

Within atomization chamber 7 the contact of the flow of waste fluid with the flow of steady flow high speed hot turbulent combustion gas mixture causes at least some and preferably most or substantially all of the waste fluid flow to atomize. The high speed hot combustion gas mixture contacting the flow of waste fluid improves the atomization effect. The use of hot gas improves the atomization process in several ways. The following nozzle equation can be used to illustrate some of these improvements.

$$U = \sqrt{\frac{2\gamma g_c R T_o}{M(\gamma - 1)}\left(1 - \frac{P}{P_0}\right)^{1-\frac{1}{\gamma}}}$$

Where:

R=gas constant

To=Gas temperature

P=outlet pressure

Po=supply pressure

M=molecular weight of gas

γ=ratio of specific heats Cp/Cv gc=gravitational constant

U=gas velocity

By raising the temperature of the gas, the same velocity is achieved using a lower supply pressure. Alternatively, with the supply pressure kept constant, a much higher gas velocity through the nozzle can be achieved.

This increase in velocity increases the force deliverable from the high speed hot combustion gas stream to the fluid flow, thus causing more fluid to atomize and also causing the atomization to form droplets of smaller mean diameter for any given set of conditions. The high temperature of the gas also serves to transfer heat to the fluid from the high speed hot combustion gas stream. This heat transfer enhances drying and/or ignition of combustibles of the fluid. It is thus seen that the method of this invention effectively provides both increased mechanical energy and increased thermal energy to the fluid and this combined increase in energy synergistically translates into improved atomization and ignition of the fluid.

The atomized fluid along with the high speed hot combustion gas mixture passes from atomization chamber 7 into combustion zone 18 wherein the atomized waste fluid combusts with the gaseous oxidant of the high speed hot combustion gas mixture. In the embodiment of the invention illustrated in FIG. 1, combustion zone 18 is shown as being a separate enclosure in flow communication with atomization chamber 7. It is understood however, that the atomization chamber and the combustion zone downstream of the atomization chamber could be a single contiguous enclosure.

The high degree of atomization of the waste fluid enhances the efficiency of the combustion reaction within the combustion zone. Moreover, the high velocity of the high speed steady flow hot combustion gas mixture that promotes atomization of the waste fluid also facilitates intimate and homogeneous mixing of the waste fluid with the gaseous oxidant within the combustion zone further improving the combustion. Still further, the high speed of the hot combustion gas mixture promotes recirculation of material that has already reacted within the combustion zone, this recirculated material being hotter than the incoming material to the combustion zone, thus serving to stabilize the flame and further sustain the combustion reaction.

The combustion zone may be any suitable device, such as a furnace, incinerator or burner, wherein the waste fluid may be combusted. If desired heat transfer fluid, e.g. water, may be brought into heat exchange relation with the combustion reaction so as to absorb and subsequently gainfully employ heat generated by the combustion reaction taking place in combustion zone 18. The combustion reaction or products may be brought into direct contact with other heat consuming processes to use the combustion heat such as for melting, heating, raising steam or causing a reaction to take place. The resulting gases from the combustion of the atomized waste fluid are withdrawn from combustion zone 18 as shown by arrows 10.

If the difficult to combust fluid contains sufficient heating value, it may be particularly desirable to only partially combust the fluid with the high speed, high temperature oxidant stream. This partial combustion is accomplished by feeding more combustible material than is needed for stoichiometric combustion with the gaseous oxidant. Subsequently the partially combusted gases are supplied with additional oxidant, typically in the form of air. This partial combustion can be used to control the peak flame temperatures in the combustion reactor. This partial oxidation can also improve the economics of this process by reducing the amount of purchased oxidant for combustion in exchange for air.

Although the invention has been described in detail with reference to a certain preferred embodiment, those skilled in the art will recognize that there are other embodiments of the invention within the spirit and the scope of the claims.

What is claimed is:

1. A method for combusting difficult to combust fluid comprising:

(A) contacting fuel with gaseous oxidant and combusting fuel with a portion of the gaseous oxidant to produce a hot combustion gas mixture containing gaseous oxidant;

(B) passing the hot combustion gas mixture in a steady flow to a nozzle and through the nozzle to form a high speed combustion gas mixture having a steady flow;

(C) contacting the high speed steady flow combustion gas mixture with a flow of difficult to combust fluid and atomizing at least some of the flow of said fluid by the contact with the high speed steady flow combustion gas mixture; and (D) combusting the atomized fluid by reaction with the gaseous oxidant of the high speed steady flow combustion gas mixture wherein the combustion of the atomized fluid takes place in a combustion zone to form reacted material, and further comprising recirculating the reacted material within the combustion zone.

2. The method of claim 1 wherein the hot combustion gas mixture has a temperature of at least 300° F.

3. The method of claim 1 wherein the fluid which contacts the high speed combustion gas mixture has a viscosity of at least 1 centipoise.

4. The method of claim 1 wherein the difficult to combust fluid is waste fluid.

5. The method of claim 1 wherein the difficult to combust fluid comprises conventional fuel.

6. The method of claim 1 wherein the difficult to combust fuel is only partially combusted with the high temperature, high velocity gaseous oxidant.

7. The method of claim 1 wherein the high speed combustion gas mixture has a velocity within the range of from 1000 to 3000 feet per second.

8. The method of claim 1 wherein the high speed steady flow combustion gas mixture is turbulent.

* * * * *